US009987870B2

(12) United States Patent
Hoarau et al.

(10) Patent No.: US 9,987,870 B2
(45) Date of Patent: Jun. 5, 2018

(54) ARRANGEMENTS AND ASSEMBLY METHODS FOR A MEDIA BINDER AND ITS COMPONENTS

(75) Inventors: Eric Hoarau, San Francisco, CA (US); Tze-Ying Sarah Ni, Redwood City, CA (US); Gary J. Dispoto, Mountain View, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 1180 days.

(21) Appl. No.: 14/123,022

(22) PCT Filed: May 31, 2011

(86) PCT No.: PCT/US2011/038647

§ 371 (c)(1),
(2), (4) Date: Nov. 27, 2013

(87) PCT Pub. No.: WO2012/166128

PCT Pub. Date: Dec. 6, 2012

(65) Prior Publication Data

US 2014/0125048 A1 May 8, 2014

(51) Int. Cl.
*B42D 1/00* (2006.01)
*B42D 19/00* (2006.01)
(Continued)

(52) U.S. Cl.
CPC ..... *B42C 7/002* (2013.01); *B42C 7/003* (2013.01); *B42D 1/08* (2013.01); *B42F 9/008* (2013.01);
(Continued)

(58) Field of Classification Search
CPC ..... B42C 7/002; B42C 7/003; B42C 7/009; B42D 1/08; B42D 1/02; B42F 9/008; B42F 1/006; B42F 1/003; B42P 2221/06
(Continued)

(56) References Cited

U.S. PATENT DOCUMENTS 1,925,424 A * 9/1933 Warner, Jr. ..... B42F 13/12 402/47
2,486,330 A 10/1949 Stanley
(Continued)

FOREIGN PATENT DOCUMENTS

CN 2269963 12/1997
CN 2378199 Y 5/2000
(Continued)

OTHER PUBLICATIONS

International Search Report and Written Opinion for PCT/US2011/038647, Korean Intellectual Property Office, dated Feb. 17, 2012.
(Continued)

*Primary Examiner* — Justin V Lewis
(74) *Attorney, Agent, or Firm* — Mannava & Kang, P.C.

(57) ABSTRACT

A media binder has an inner assembly and a case assembly, The inner assembly includes inside boards pre-attached to a binding mechanism. Adhesive is placed on outward surfaces of the inside boards. The case assembly includes a cover sheet with at least one marginal edge attached to surface boards and at least one loose edge. To customize cover, a printed cover is inserted in-between the cover sheet and the surface board through an opening formed by the loose edge. The case assembly is then laminated. The laminated case assembly is combined with the inner assembly using the adhesive on the inside boards. A one-piece media binder has cover sheets wrapping around surface boards forming pockets. The surface boards are partially attached to paste downs. To customize cover, printed covers are inserted into the pockets, and the paste downs are then attached to the surface boards to seal loose edges.

22 Claims, 10 Drawing Sheets

(51) Int. Cl.

| | |
|---|---|
| ***B42D 5/00*** | (2006.01) |
| ***B42D 3/00*** | (2006.01) |
| ***B42D 15/00*** | (2006.01) |
| ***B42F 3/00*** | (2006.01) |
| ***B42F 13/02*** | (2006.01) |
| ***B42F 13/06*** | (2006.01) |
| ***B42F 13/08*** | (2006.01) |
| ***B42F 3/02*** | (2006.01) |
| ***B42F 13/12*** | (2006.01) |
| ***B42F 13/00*** | (2006.01) |
| ***B42C 7/00*** | (2006.01) |
| ***B42F 9/00*** | (2006.01) |
| ***B42D 1/08*** | (2006.01) |
| *B42D 1/02* | (2006.01) |
| *B42F 1/00* | (2006.01) |

(52) U.S. Cl.
CPC ..... *B42C 7/009* (2013.01); *B42D 1/02* (2013.01); *B42F 1/003* (2013.01); *B42F 1/006* (2013.01); *B42P 2221/06* (2013.01)

(58) Field of Classification Search
USPC ..... 281/2, 3.1, 5, 6, 15.1, 20, 21.1, 29; 283/63.1, 64; 402/8, 9, 18, 19, 70, 71, 402/73, 74, 75, 76, 77, 78, 502
See application file for complete search history.

(56) References Cited

U.S. PATENT DOCUMENTS

| | | | | |
|---|---|---|---|---|
| 3,174,773 | A * | 3/1965 | True | B42D 3/02 281/29 |
| 4,629,349 | A | 12/1986 | Pitts | |
| 4,958,855 | A | 9/1990 | Shipp | |
| 5,876,143 | A | 3/1999 | Ong | |
| 5,938,241 | A | 8/1999 | Wilson | |
| 6,039,494 | A | 3/2000 | Pearce | |
| 6,250,867 | B1 | 6/2001 | Gwyn et al. | |
| 6,305,714 | B1 | 10/2001 | Rossetto et al. | |
| 7,757,358 | B2 | 7/2010 | Hoarau et al. | |
| 7,798,736 | B2 | 9/2010 | Hoarau et al. | |
| 7,823,927 | B2 | 11/2010 | Hoarau et al. | |
| 7,988,198 | B2 | 8/2011 | Wang | |
| 2004/0066030 | A1* | 4/2004 | Parker | B42C 11/04 281/21.1 |
| 2004/0108709 | A1 | 6/2004 | Hengsbach | |
| 2004/0120794 | A1 | 6/2004 | Parker | |
| 2006/0198719 | A1 | 9/2006 | Parker et al. | |
| 2006/0237961 | A1 | 10/2006 | Partain et al. | |
| 2007/0085329 | A1 | 4/2007 | Silverman | |
| 2007/0086846 | A1 | 4/2007 | Hough et al. | |
| 2008/0018089 | A1 | 1/2008 | Hoarau | |
| 2008/0018090 | A1 | 1/2008 | Hoarau et al. | |
| 2008/0093836 | A1 | 4/2008 | Hoarau et al. | |
| 2008/0175653 | A1 | 7/2008 | Su | |
| 2008/0213032 | A1* | 9/2008 | Hoarau | B42F 9/008 402/20 |
| 2008/0226385 | A1 | 9/2008 | Ruble | |
| 2010/0156085 | A1 | 6/2010 | Devoy et al. | |
| 2010/0158639 | A1 | 6/2010 | Manico et al. | |

FOREIGN PATENT DOCUMENTS

| | | | |
|---|---|---|---|
| CN | 1343570 | | 4/2002 |
| CN | 2557002 | | 6/2003 |
| CN | 1506236 | | 6/2004 |
| CN | 1684841 | | 10/2005 |
| CN | 2837089 | Y | 11/2006 |
| CN | 201169138 | Y | 12/2008 |
| CN | 101547797 | | 9/2009 |
| CN | 201304772 | Y | 9/2009 |
| CN | 201511627 | | 6/2010 |
| FR | 2909923 | | 6/2008 |
| GB | 157013 | A | 9/1980 |
| JP | 11180068 | | 6/1999 |
| JP | 2004299364 | | 10/2004 |
| JP | 2008137370 | | 6/2008 |
| JP | 2010036568 | | 2/2010 |
| JP | 2011056781 | | 3/2011 |
| KR | 20080104654 | | 12/2008 |
| WO | WO-0134404 | | 5/2001 |
| WO | WO-2009123577 | A1 | 10/2009 |
| WO | WO-2012/166128 | | 12/2012 |
| WO | WO-2012/166129 | | 12/2012 |

OTHER PUBLICATIONS

International Search Report dated Sep. 30, 2014 issued on Chinese Patent Application No. 201280016461.7 dated Feb. 24, 2012, The State Intellectual Property Office, P.R. China.

International Search Report dated Sep. 25, 2014 issued on Chinese Patent Application No. 201280016469.3 dated Feb. 24, 2012, The State Intellectual Property Office, P.R. China.

* cited by examiner

Picture
Prepare Custom Cover
810
Insert Custom Cover into
Case Assembly
820
Attach Loose Edges
830
Laminating Device
Picture
Laminate Case Assembly
840
Assemble Media Binder
850

ARRANGEMENTS AND ASSEMBLY METHODS FOR A MEDIA BINDER AND ITS COMPONENTS

CLAIM FOR PRIORITY

The present application is a national stage filing under 35 U.S.C. 371 of PCT application number PCT/US2011/038647, having an international filing date of May 31, 2011, the disclosure of which is hereby incorporated by reference in it entirety.

BACKGROUND

As digital cameras gain popularity, the volume of digital pictures taken by users grows rapidly. Although these pictures may be conveniently stored in storage devices, at least some users prefer to store their pictures in a printed format. For those users, a media binder is a desirable option for storing their pictures.

Currently available media binders typically come in manufacture-fixed designs with no or very few customization options. As a result, such media binders typically either do not allow the user to customize the binder appearance or they require complicated and/or difficult customization processes. Therefore, what are needed are media binders that are easy to customize and assemble, provide aesthetically pleasing binding results, and may be manufactured efficiently and cost-effectively.

DETAILED DESCRIPTION

The present subject matter is now described more fully with reference to the accompanying figures, in which several embodiments of the subject matter are shown. The present subject matter may be embodied in many different forms and should not be construed as limited to the embodiments set forth herein. Rather these embodiments are provided so that this disclosure will be complete and will fully convey principles of the subject matter.

Media Binder

Figure 1A:
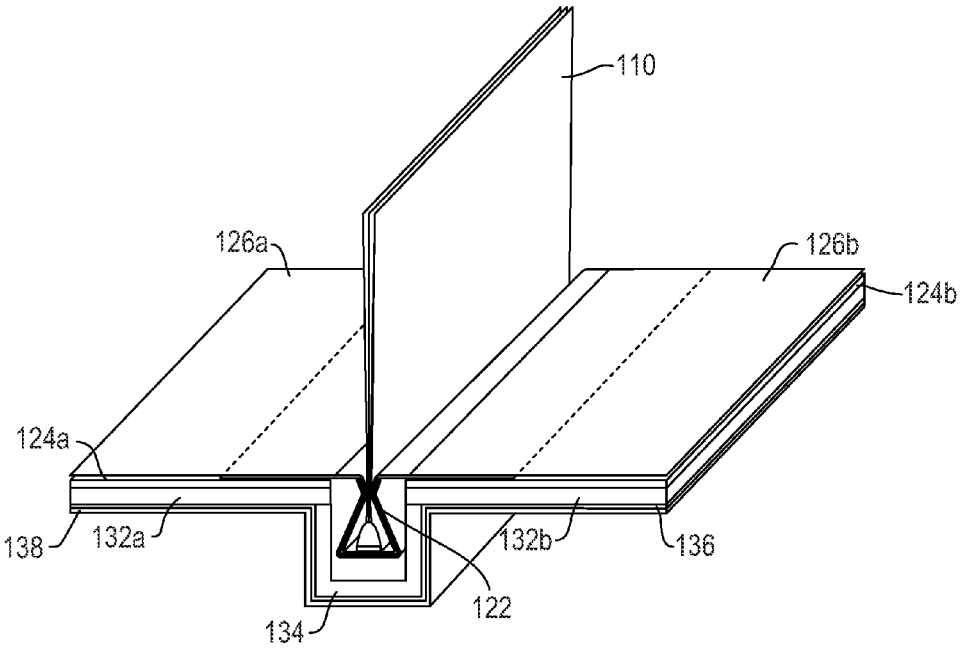
FIG. 1A is a perspective view of an embodiment of a media binder.
Figure 1B:
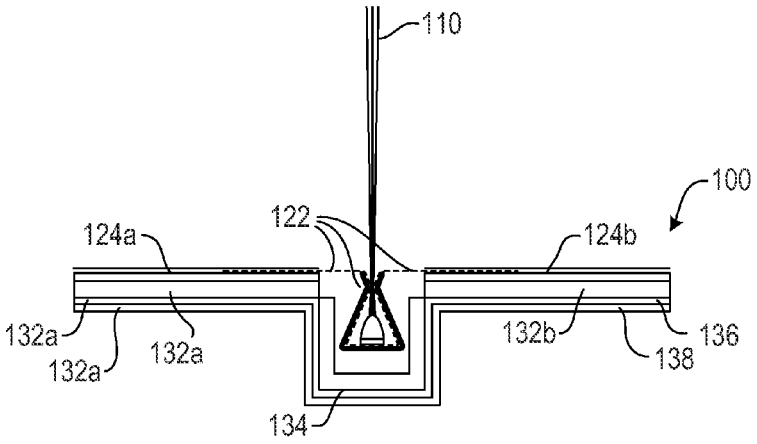
FIG. 1B is a side view of the media binder shown in FIG. 1A.

FIGS. 1A and 1B show an embodiment of a media binder arrangement (also called, a "media binder") 100. In the illustrations, the media binder 100 is opened approximately 180° from a closed position. In this position, physical media 110 inserted in the media binder 100 may be firmly secured in place while being viewed. Examples of the physical media 110 that may be secured in the media binder 100 described herein include photo paper, paper, card stock, business cards, fabric samples, carpet samples, synthetic membranes, acetate sheets, and the like.

The media binder 100 includes two primary components: an inside assembly and a case assembly. The inside assembly includes a front inside board 124*a*, a back inside board 124*b*, a binding mechanism 122, a front paste down 126*a*, and a back paste down 126*b*. The case assembly includes a front surface board 132*a*, a back surface board 132*b*, a spine surface board 134, a binding sheet 136, and a transparent (or semitransparent) cover sheet 138. The inside assembly, the case assembly, and their components will be described in detail below.

In embodiments disclosed herein, the appearance of the media binder 100 may be customized by adding a custom cover behind the cover sheet 138. The case assembly and the inside assembly can be manufactured in advance (e.g., at a manufacturing site). The customization of the case assembly and the combination of the two assemblies can take place at the client side (e.g., at a retailer site).

Covers of the media binder 100 (e.g., the surface boards 132) may be utilized to enable the user to easily add, remove, and/or replace the physical media 110 in the media binder 100. The binding mechanism 112 secures the physical media 110 inserted in the media binder 100 using forces (e.g., clamping forces of sprint clamps included therein), and the media binder 100 is configured to apply an opening force to the binding mechanism 122 to overcome the forces when the binder covers are opened. For example, when the media binder 100 is opened from a first position greater than approximately 270° to a second position at approximately 360°, an opening force is applied to the binding mechanism 122, causing it to release any physical media 110 secured therein.

Inside Assembly

Figure 2A:
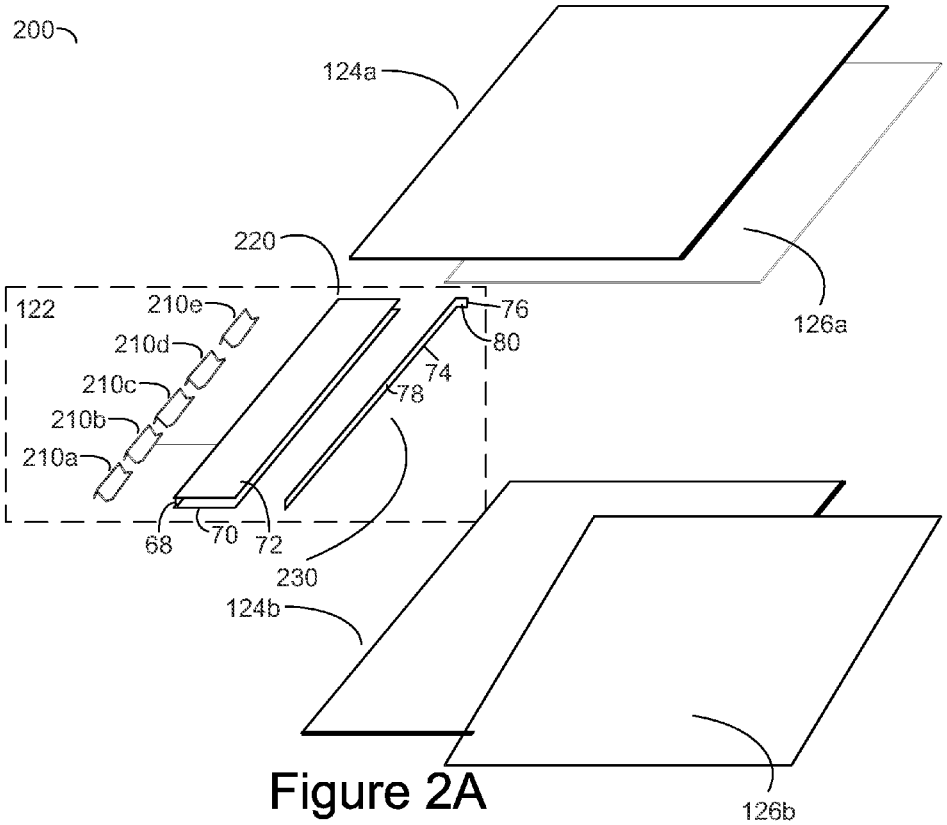
FIG. 2A is an exploded view of an embodiment of an inside assembly.
Figure 2B:
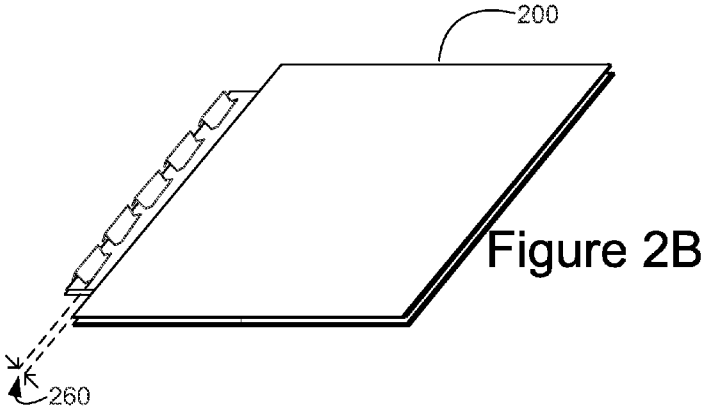
FIG. 2B is a perspective view of the inside assembly shown in FIG. 2A.

FIG. 2A shows an exploded view of an embodiment of an inside assembly 200 that includes a binding mechanism 122, a front inside board 124*a*, a back inside board 124*b*, a front paste down 126*a*, arid a back paste down 126*b*. The binding mechanism 122 functions to align the physical media 110 within the media binder 100 and securely hold the physical media 110 in place. The binding mechanism 122 includes one or more spring clamps also called "spine clamps") such as spine clamps 210*a*, 210*b*, 210*c*, 210*d*, 210*e*, a tension sheet 220, and a datum alignment member 230. FIG. 2B is a perspective view of the inside assembly 200 assembled using the components shown in FIG. 2A.

A spine clamp 210 is a fastening device that operates to securely hold the physical media 110 inserted between clamping surfaces of the spine clamp 210 in place. A spine clamp 210 may be configured to provide a clamping force to accommodate one or more sheets or pages of the physical media 110 such that the physical media 110 may be retained as the media binder 100 is being handled. Examples of the clamping force range between 0.1 and 50 pound-force ("lb.") per linear inch of clamping surface. The clamping force may be measured by measuring the force needed to open the spine clamp 210 by pulling at the edges of the clamp where the clamping surfaces meet. In general, the spine clamps 210 may be implemented a wide variety of different ways. Example implementations of the spine clamps 210 are disclosed in U.S. Pat. Nos. 7,798,736, 7,922,207, and U.S. Pat. No. 7,757,358, the disclosures of which are incorporated by reference in their entirety.

Figure 3:
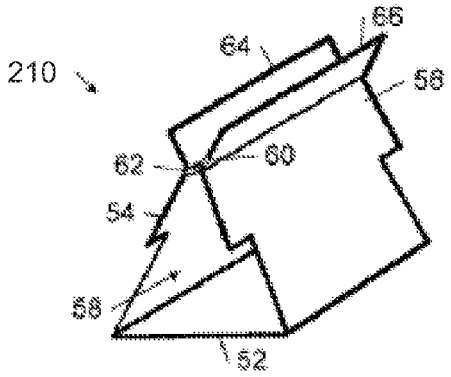
FIG. 3 is a perspective view of an embodiment of a spine clamp.

FIG. 3 shows an example spine clamp 210 in which the opposing terminal ends of the clamping sides 54, 56 have respective edge features 64, 66. In this example, the spine clamps 210 is formed of a rectangular sheet of material (e.g., spring steel, sheet metal, or a resilient polymeric material) that is bent along two parallel fold lines to form a backside 52 and two clamping sides 54, 56, which have inner surfaces that define a respective holding volume (the "interior cavity") 58 in the shape of a triangular cylinder and operable to receive the physical media 110. The opposing terminal ends of the clamping sides 54, 56 have clampinig surfaces 60, 62, which hold the physical media 110 inserted therebetween. The edge features 64, 66 are outwardly creased portions of the terminal ends of the clamping sides 54, 56. In response to a sufficient applied force, the opposing inner surfaces of the clamping sides 54, 56 of the spine clamp 210 move away from one another from a closed state to an open state.

Referring back to FIG. 2A, the tension sheet 220 operates to transmit an opening force to one or more spine clamps such as the spine clamps 210. The tension sheet 220 typically includes a substantially inelastic body, which may be formed of one or more of a wide variety of different material compositions such as a substantially inelastic polymeric compound and a substantially inelastic textile fabric. The tension sheet 220 has a central portion 68 and first and second side portions 70, 72. During assembly of the inside assembly 200, the central portion 68 of the tension sheet 220 is securely affixed within the holding volumes 58 of the spine clamps 210 between the datum alignment member 230 and the inner surfaces of the spine clamps 210. In addition, the first and second side portions 70, 72 of the tension sheet 220 are attached to the front inside board 124*a* and the back inside board 124*b*, respectively. In this way, the tension sheet 220 is operable to transmit an opening force from the inside boards 124*a*, 124*b* to the clamping surfaces 60, 62 of the spine clamps 210.

The datum alignment member 230 operates to facilitate easy and proper alignment of the physical media 110 inside the media binder 100. In addition, the datum alignment member 230 operates to limit the marginal width of the physical media 110 captured by the spine clamps 210, which may result in a more aesthetically pleasing appearance. The datum alignment member 230 is secured together with the spine clamps 210 and the tension sheet 220 during assembly of the binding mechanism 122, and includes a spacer 74 and an integral datum stop 76. After assembly of the binding mechanism 122, the spacer 71 extends through the holding volumes 58 of the spine clamps 210 and the spine clamps 210 are secured at spaced apart locations along the spacer 74. The spacer 71 has a planar datum surface 78 against which sheets of physical media 110 may be registered so that the opposite ends of the sheets present a clean edge to the user. The datum surface 78 also limits the insertion depth of the physical media 110 into the spine clamps 210 to reduce the marginal portions of the physical media 110 that are obscured by the binding mechanism 122. In this regard, the spacer 74 has a thickness that positions the datum surface 78 a desired height above the central portion 68 of the tension sheet 220 within the holding volumes 58 of the spine clamps 210. The datum stop 76 is disposed at a distal end of the spacer 74. The datum stop 76 has a datum stop surface 80 that is orthogonal to the datum surface 78. The datum stop surface 80 provides a second edge against which the physical media 110 may be registered to achieve an aesthetically pleasing binding of the physical media 110 with aligned edges. A second datum stop may be provided at the opposite end of the spacer 74. The datum alignment member 230 typically is formed of a rigid material (e.g., a rigid plastic or metal material).

The side boards 124*a*, 124*b* operate to facilitate proper alignment of the binding mechanism 122 in the media binder 100. Because the surface boards 132 function as levers in opening the binding mechanism 122, misalignment of the binding mechanism 122 may cause the media binder 100 difficult to operate. Thus, proper alignment of the binding mechanism 122 is important for the media binder 100 to function properly. However, for reasons such as customizing the binder cover, the media binder 100 may be assembled by low proficiency workforce at sites equipped with no or few specialized tools (e.g., a retailer site, home). As will be described in detail below and illustrated in FIG. 8, the inside boards 124 facilitate a simple and error-proof process for properly aligning the binding mechanism 122 in the media binder 100 that requires little training for the user conducting the assembly and few tools.

The inside boards 124 typically are formed of one or more layers of rigid material such as paperboard, metal, fabric, plastic, and a stiff polymeric material. The thickness of the inside board 124 may vary (e,g., between 0.01 inch and 0.20 inch) as desired. The inside boards 124 may be prepared (e.g., cut) such that the primary direction of fibers in the inside boards 124 (also called "fiber orientation", "grain direction") is orthogonal to the orientation of the spine of the media binder 100 (also called the "spine orientation"). This arrangement, together with setting the fiber orientations of the surface board 132 to be parallel to the spine orientation, prevents or reduces the warping effect on the binder covers while maintaining their stiffness.

The inside boards 124*a*, 124*b* are attached to the side portions 70, 72 of the tension sheet 220 in parallel to the spacer 74. The distance 260 between the spine clamps 210 and the inside boards 124 as connected by the tension sheet 220 is important because it affects the operation range of the media binder 100 to open the binding mechanism 122 (e.g., the range of opening angles of the surface boards 132 when an opening force is applied to the spine clamps 210). Thus, the inside board 124 should be properly aligned with the binding mechanism 122 (e.g., parallel to the spacer 74) in the inside assembly to ensure that the media binder 100 has a desired operation range (e.g., opening angle between 270° and 360°). To ensure the proper alignment of the inside boards 124 and the binding mechanism 122, the internal assembly is pre-assembled at a manufacturing site by experienced manufacturing workers using specialized tools.

A layer of adhesive (e.g., pressure sensitive adhesive (PSA)) is placed on the outwardly facing surface of the inside boards 124 (i.e., the surface opposite o the inwardly facing surface attached to the tension sheet 220) with a sheet of release liner placed on top to protect the adhesive for ease of transportation and storage. The release liner may be formed of one or more materials including paper, fabric, and plastic. The release liner is removed before the inside assembly 200 and the case assembly are combined using the adhesive (e.g., at the retailer site).

As noted above, one important design goal of the inside boards 124 is to facilitate simple and error-proof alignment of the binding mechanism 122 in the media binder 100. To achieve this goal, in one embodiment, the size of the inside boards 124 is set to be approximately the same as (or similar to) the size of the surface boards 132, such that the inside boards 124 and the surface boards 132 can be easily aligned when the inside assembly 200 and the case assembly are combined, thereby ensuring the proper alignment of the inside board 124 in the media binder 100. Alternatively or additionally, the size of the inside boards 124 may be different from the size of the surface boards 132. For example, the inside boards 124 may be 0.05-0.5 inch shorter and/or narrower than the surface boards 132. To facilitate proper alignment between the inside boards 124 and the surface boards 132, an alignment tool may be provided. Depending on the sizes of the boards 124, 132, the alignment tool has edges and/or corners to accommodate the boards 124, 134 such that when the boards 124, 134 are registered with the edges/corners of the alignment tool, the boards 124, 134 are properly aligned with each other.

The paste downs 126*a*, 126*b* are attached to the inwardly facing surfaces of the inside boards 124*a*, 124*b*, respectively, for covering up the side portions 70, 72 of the tension sheet 220 attached to the inside boards 124, which may result in a more aesthetically pleasing appearance. In addition, the paste downs 126 also function to further secure the tension sheet 220 to the inside boards 124. The paste downs 126 are formed of a wide variety of different materials such as paper, plastic, metal, fiber, and film.

Figure 4:
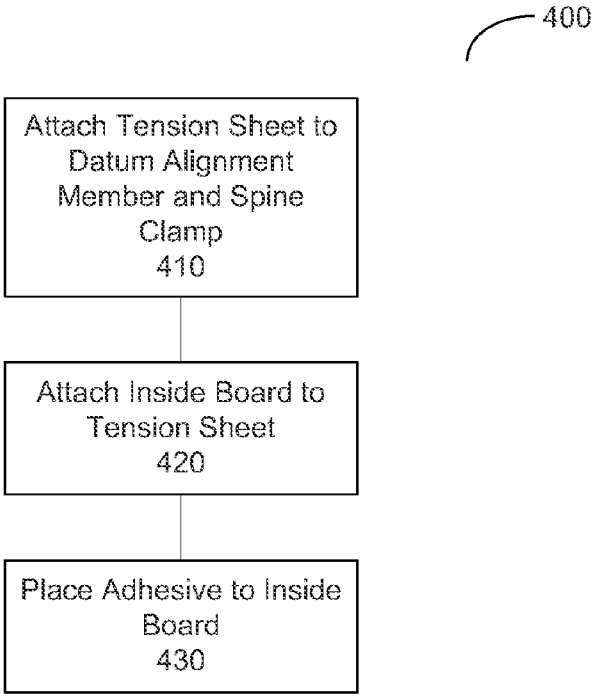
FIG. 4 is a flow diagram of an embodiment of a method of manufacturing the inside assembly shown in FIG. 2B.

FIG. 4 shows an embodiment of a method 400 of manufacturing the inside assembly 200, which is shown in FIG. 2B. Other embodiments perform the steps in different orders and/or perform different or additional steps than the ones shown in FIG. 4.

In step 410, the central portion 68 of the tension sheet 220 and the spacer 74 of the datum alignment member 230 are attached to an interior cavity the holding volume 58) defined by the spine clamps 210. The tension sheet 220 may be positioned in-between the spine clamps 210 and the datum alignment member 230. The spine clamps 210 may be attached to the spacer 74 by inserting a coupling member through respective holes in the spine clamps 210, by heat staking the spacer 74 to the spine clamps 210, or by mechanically interlocking engagement features of the spacer 74 with respective engagement features of the spine clamps 210.

In step 420, the side portions 70, 72 of the tension sheet 220 are attached to the inside boards 124*a*, 124*b*, respectively, over the clamp edge features 64, 66. The paste downs 126*a*, 126*b* may then be attached to the inside boards 124*a*, 124*b*, respectively, to cover aver the portions of the side portions 70, 72 affixed to the inside boards 124*a*, 124*b*.

In step 430, a layer of adhesive (e.g., PSA) is placed on an outwardly facing surface of the inside boards 124*a*, 124*b* with a sheet of release liner placed on top to cover over the layer of adhesive.

As noted above, proper alignment of the inside assembly 200 is important to ensure that the media binder 100 functions properly. Accordingly, the method 400 may be practices in a manufacturing site by experienced manufacturing workers using specialized tools to ensure proper alignment.

Figure 5A:
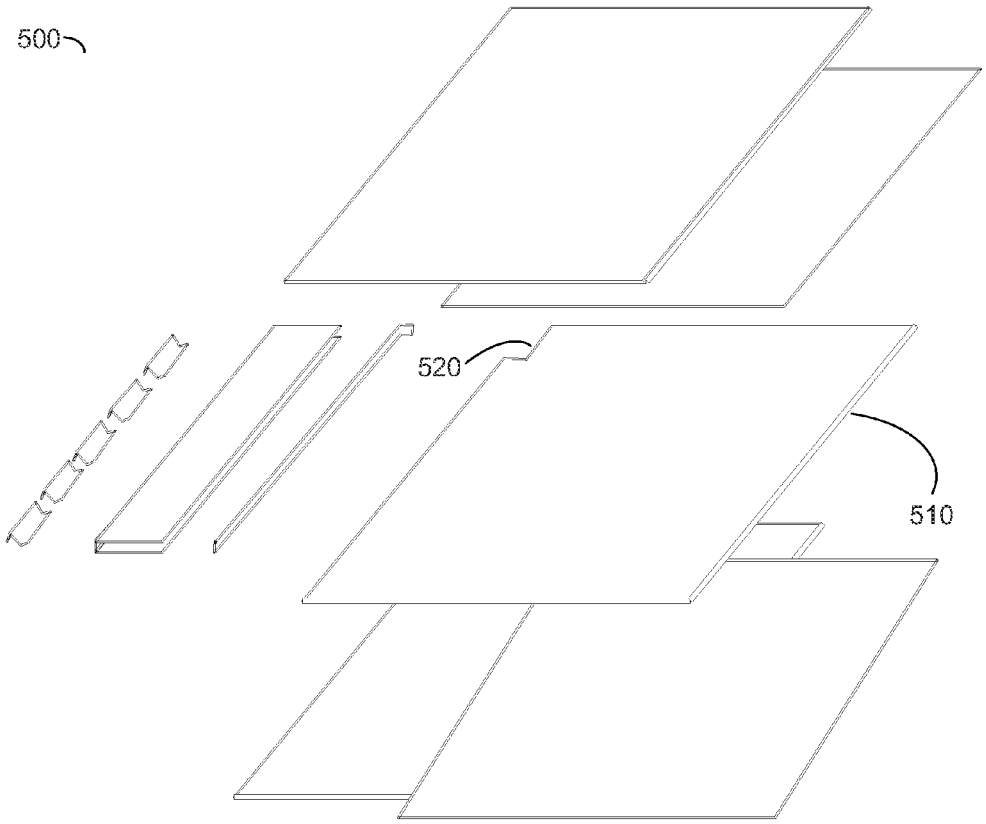
FIG. 5A is an exploded view of an embodiment of an inside assembly.
Figure 5B:
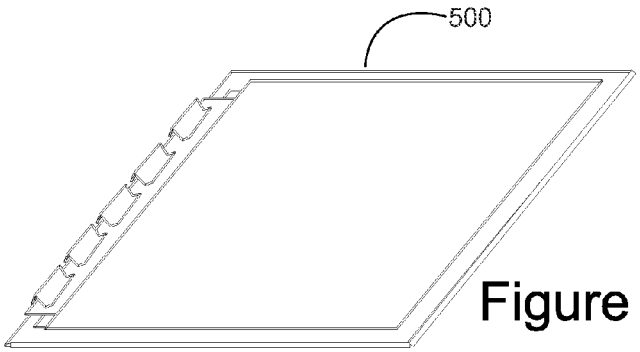
FIG. 5B is a perspective view of the inside assembly shown in FIG. 5A.

FIGS. 5A and 5B show another embodiment of an inside assembly 500. In this embodiment, an alignment board 510 is added to the inside assembly 500 to further error proof the process of assembling the inside assembly 500 with the case assembly. As shown, the alignment board 510 is a piece of rectangular board with a rectangular cavity 520 in a corner. The alignment board 510 typically is formed of one or more layers of rigid material such as paperboard, metal, plastic, fiber, and a stiff polymeric material. During assembly of the inside assembly 500, the alignment board 510 is inserted into the binding mechanism 122 such that the alignment board 510 registers with the spacer 74 and the cavity 520 registers with the datum stop 76. The alignment board 510 can be used to align the inside assembly 500 with the case assembly, and can be removed and reused thereafter. The alignment board 510 maybe a fiat board as shown in FIGS. 5A and 5B. Alternatively, the alignment board 510 may have thicker edges for fitting the inside boards 124 and the surface boards 132 inside the edges, and thereby facilitate easy alignment between the inside assembly 500 and the case assembly. Because the alignment board 510 provides the stiffness needed for handling the inside assembly 500, the inside boards of the inside assembly 500 may be thin and/or less rigid.

Figure 6A:
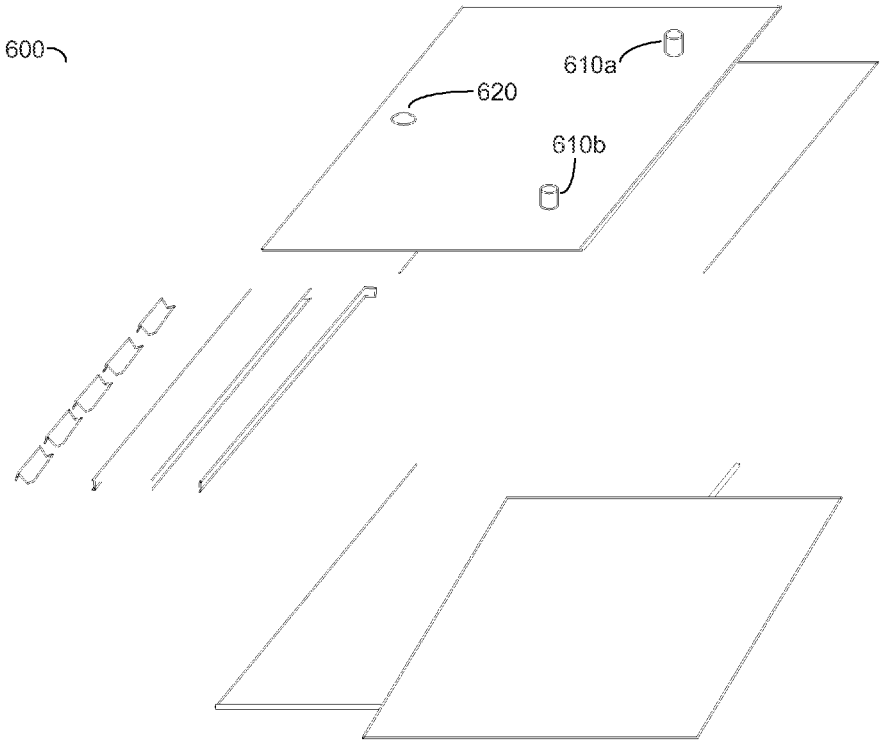
FIG. 6A is an exploded view of an embodiment of an inside assembly.
Figure 6B:
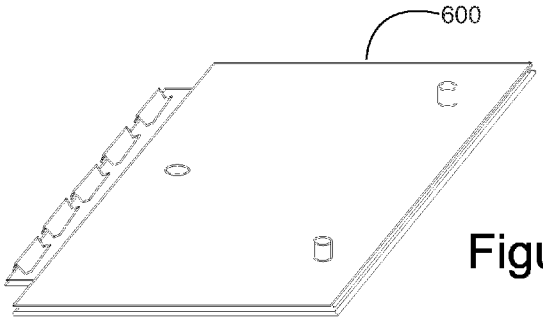
FIG. 6B is a perspective view of the inside assembly shown in FIG. 6A.

FIGS. 6A and 6B shows yet another embodiment of an inside assembly 600. As shown, alignment pins 610*a* and 610*b* and a alignment hole 620 are placed on the outwardly facing surface of an inside board 124 to further ensure that the inside assembly 600 and the case assembly are properly aligned. There may be more or fewer alignment pins holes as illustrated. The arrangement of the alignment pins and/or holes on the inside boards 124 are designed in a manner that facilitate proper alignment/orientation between the case assembly and the inside assembly 600.

Case Assembly

Figure 7A:
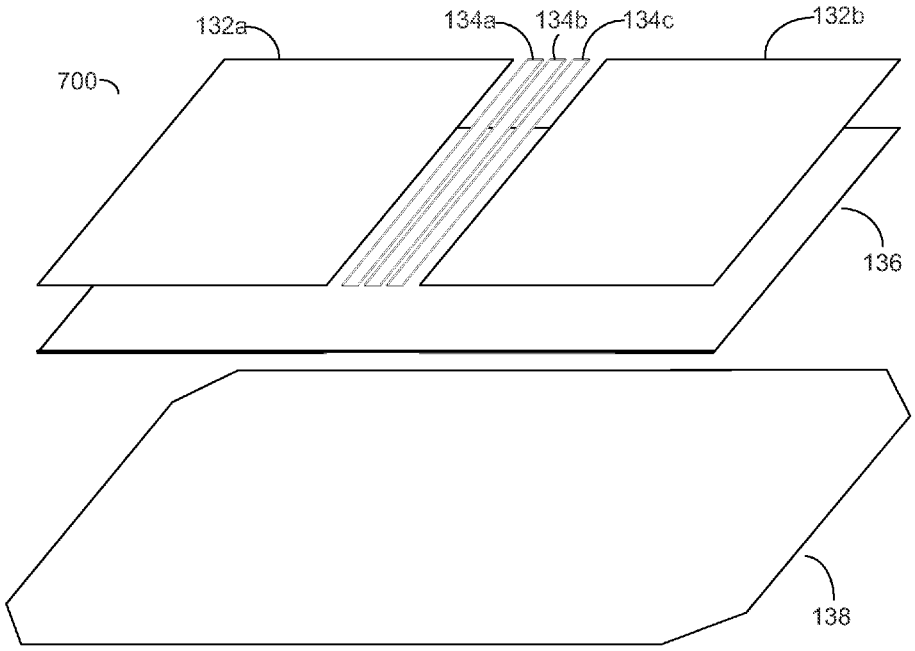
FIG. 7A is an exploded view of an embodiment of a case assembly.
Figure 7B:
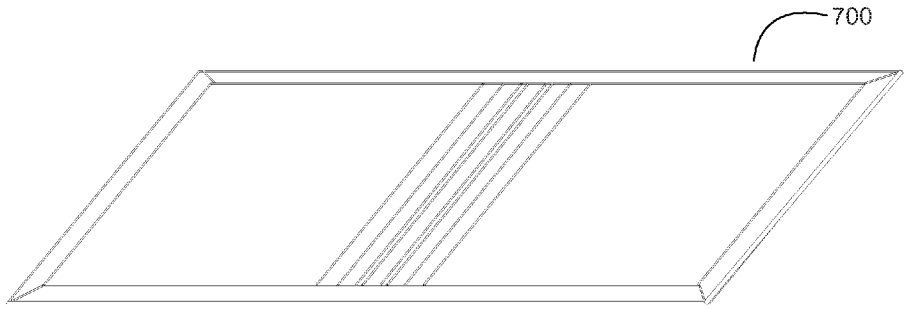
FIG. 7B is a perspective view of the case assembly shown in FIG. 7A.

FIG. 7A shows an exploded view of an embodiment of a case assembly 700 that includes spine surface boards 134*a*, 134*b*, 134*c*, a front surface board 132*a*, a back surface board 132*b*, a binding sheet 136, and a cover sheet 138. FIG. 7B is a perspective view of the case assembly 700 assembled using the components shown in FIG. 7A.

Each of the surface boards 134*a*, 134*b*, 134*c*, 132*a*, 132*b* may be formed of a durable material (e.g., a textile), a rigid planar material (e.g., paperboard, metal, plastic, fiber, or a stiff polymeric material), or one or more layers of such materials. Three spine surface boards 134*a*, 134*b*, 134*c* are illustrated to collectively form a spine base to facilitate bending during opening and closing of the media binder 100. In other examples, the spine base may be unsegmented or it may be segmented into two or more than three spine surface boards 134.

The fiber orientations of the surface boards 132, 134 may be set to be parallel to the spine orientation of the media binder 100. This arrangement together with setting the fiber orientations of the inside board 124 to be orthogonal to the spine orientation, prevents or reduces the warping effect on the binder covers while maintaining their stiffness. The thickness of the surface boards 132, 134 may vary (e.g., between 0.01 inch and 0.20 inch) as desired and is typically thicker than the inside boards 124.

The binding sheet 136 functions to bind the surface boards 132, 134 together and may be composed of material such as a substantially inelastic textile fabric. The surface boards 132, 134 are attached to the inwardly facing surface of the binding sheet 136 using an adhesive. The binding sheet 136 may reach the side edges such as the unbound edges (i.e., the side edges opposite to the spine) of the surface boards 132, may wrap around the side edges, or may not reach the side edges. A layer of hot melt adhesive may be placed on the outwardly facing surface of the binding sheet 136.

The cover sheet 138 wraps around the surface boards 134*a*, 134*b*, 134*c*, 132*a*, 132*b* and the binding sheet 136 and functions to form a pocket for housing a custom cover and to protect the custom cover from damages (e.g., scratches) and/or degradation due to natural elements (e.g., light and water). The cover sheet 138 may be formed of a transparent (or semitransparent) material such as plastic, an acetate material and a single or composite polymeric film (e.g., polyethylene terephthalate (PET), polyvinyl chloride (PVC)). The marginal edges of the cover sheet 138 are folded over the side edges of the surface boards 132, 134. One or more of the folded marginal edges are affixed to the inwardly facing surfaces of the surface boards 132, 134, while the remaining folded marginal edges are unattached (also called "unengaged edges", "loose edges") and can be opened such that a custom cover (e.g., a sheet of photo paper) may be inserted in-between the binding sheet 136 and the cover sheet 138 through the opening. An adhesive strip (e.g., PSA) may be placed on the inwardly facing surface of the unattached, folded marginal edges of the cover sheet 138 with a strip of release liner covering the adhesive strip. A layer of hot melt adhesive may be placed on the central area (e.g., the area surrounded by the marginal edges) of the inwardly facing surface of the cover sheet 138 or cover the entire inwardly facing surface for ease of manufacture.

The thickness of the cover sheet 138 may vary (e,g., between 0.001 inch to 0.010 inch) as desired but is typically thin enough to be wrapped around the side edges of the surface boards 132, 134 and to bend around the spine base, and is thick enough to be safely transported and handled, to reduce the likelihood of wrinkles if laminated, and to resist tearing during assembly and use. In one example, the cover sheet 138 is around 0.003 inch thick. To provide additional structure and/or thickness to the unattached marginal edges of the cover sheet 138 and thereby enhance easy handling of the marginal edges, the adhesive strip placed thereon is a strip of double-sided tape that ranges 2 to 10 thousands of an inch (e.g., 2.5 thousands of an inch) in thickness.

The case assembly 700 may include additional features, such as alignment pins and/or holes for accommodating the alignment hole 620 and pins 610 of the inside assembly 600.

Method of Creating A Media Binder with a Customized Cover

Figure 8:
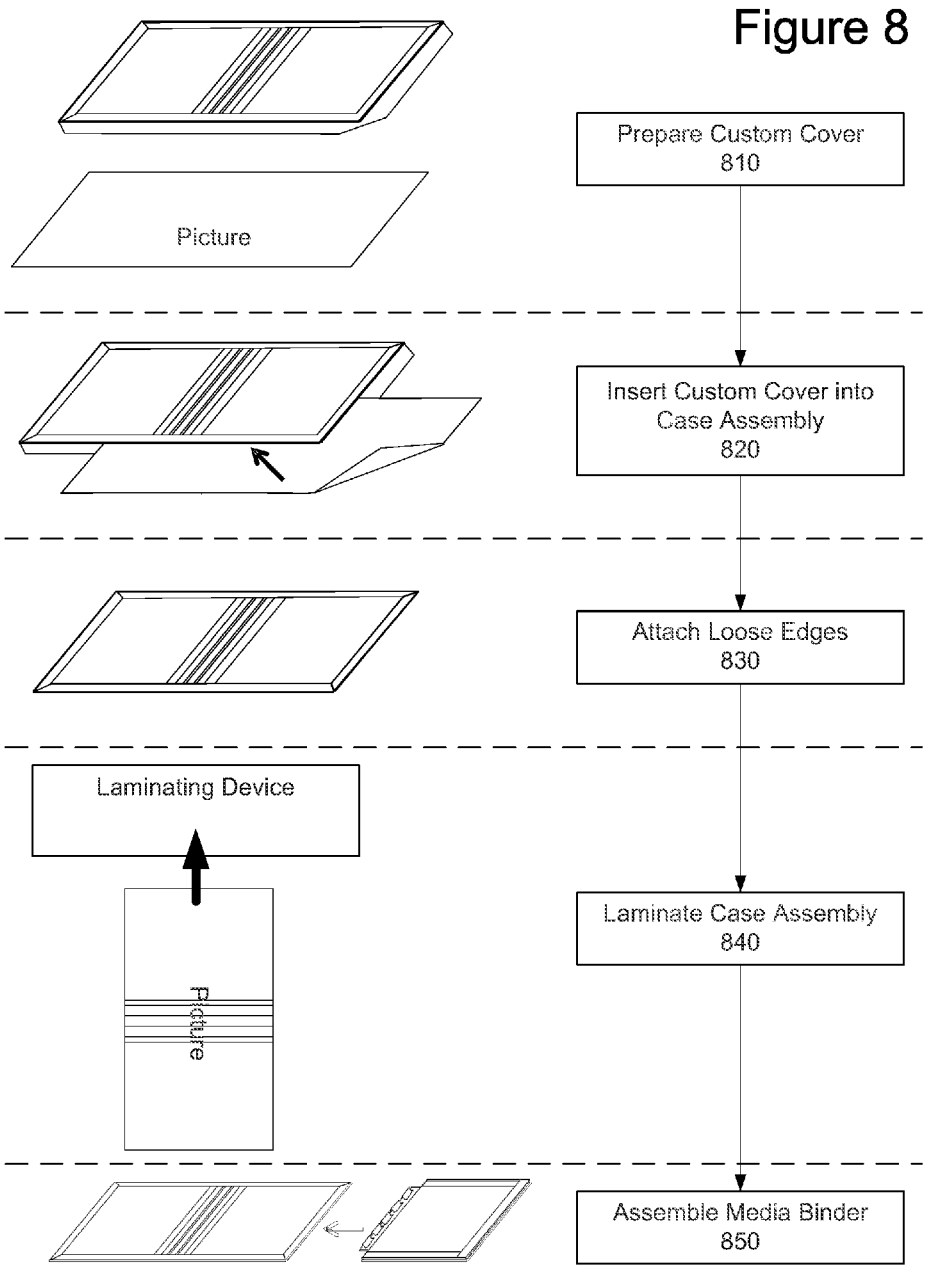
FIG. 8 is a flow diagram of an embodiment of a method of creating a media binder with a customized case cover from the inside assembly and the ease assembly shown in FIGS. 2B and 7B.

FIG. 8 shows an embodiment of a method 800 of creating a media binder 100 with a customized case cover from the inside assembly 200 and the case assembly 700, which are shown in FIGS. 2A-B and FIGS. 7A-B, respectively. Other embodiments perform the steps in different orders and/or perform different or additional steps than the ones shown in FIG. 8.

In step 810, a custom cover is printed and, if needed, cut to a desired size and shape that can fit in the case assembly 700, which is preassembled at the manufacturing site.

In step 820, the custom cover is inserted in-between the binding sheet 136 and the cover sheet 138 of the case assembly 700 through the two loose edges of the cover sheet 138 and aligned with the surface boards 132, 134. As shown, since the cover sheet 138 is pre-attached to the surface boards 132, 134 on two edges, the alignment is simple and error-proof. Alternatively, the cover sheet 138 is pre-attached to the surface boards 132, 134 on one or three edges.

In step 830, the two loose edges are wrapped around the surface boards 132, 134 and attached to the surface boards 132, 134 using an adhesive (e.g., PSA).

In step 840, the case assembly 700 is passed through hot rollers (e.g., hot rollers of a laminating device) to bind the custom cover together with the cover she 138 and/or the binding sheet 136, and thereby forms a finished binder cover appearance. As noted above, a layer of hot melt adhesive was placed on the inwardly facing surface of the cover sheet 138 and/or the outwardly facing surface of the binding sheet 136. The heated rollers activate the hot melt adhesive to bind the custom cover to the cover sheet 138 and/or the binding sheet 136. The heated rollers may also bind the loose edges to the surface boards 132, 134.

Figure 9:
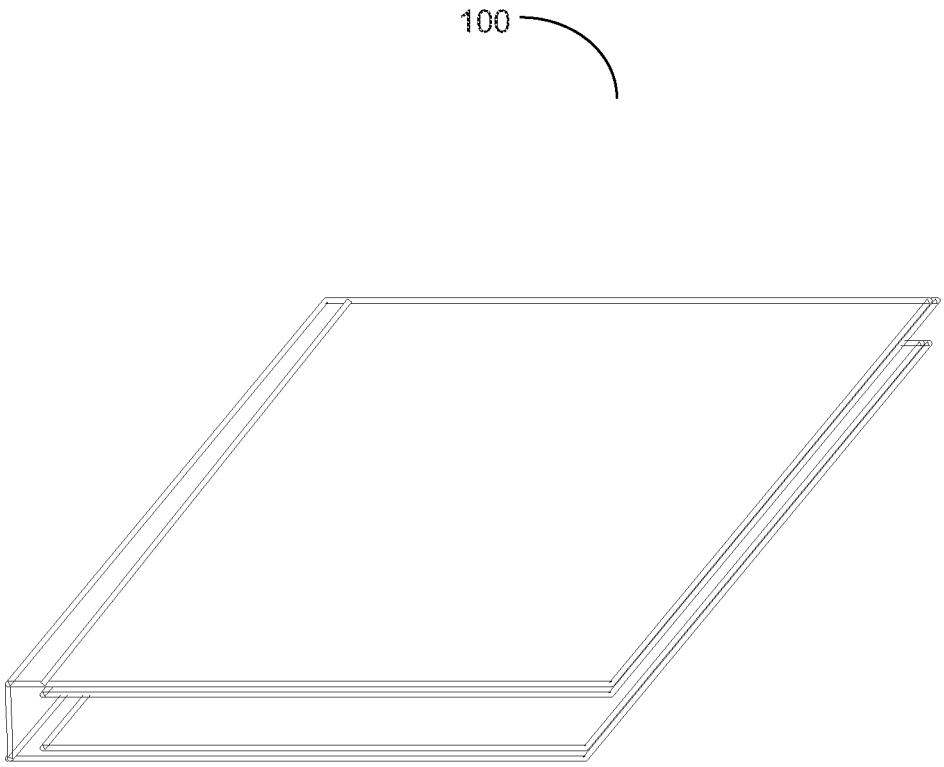
FIG. 9 is a perspective view of the media binder created using the method shown in FIG. 8.

In step 850, the inside assembly 200 and the case assembly 700 are combined to complete the media binder 100. As noted above, the inside assembly 200 and the case assembly 700 can be easily aligned (e.g., by lining up the edges of the inside boards 124 with the surface boards 132) and attached (e.g., by removing the release liners and then pressing the two assemblies 200, 700 together tightly) using the PSA on the inside boards 124. The resulting media binder 100 is properly aligned, robust, and has a professionally finished and aesthetically pleasing appearance. FIG. 9 is a perspective view of the media binder 100 assembled using the method 800.

Because the inside assembly 200 and the case assembly 700 can be pre-assembled at manufacturing sites to facilitate easy customization, error-proof alignment, and simple assembly, the process 800 has relatively few steps, all of which are relatively easy to perform and requires no or few special tools, and thus reduces mistakes that may happen during the assembly. As a result, the method 800 may be practiced by low proficiency workforce at sites equipped with no or few specialized tools (e.g., a retailer site, home). The method 800 may be applied to customize and/or assemble any binding solution that includes a case, and not necessarily to the embodiments of internal assembly and/or case assembly described herein. For example, the binding mechanism 122 can use perfect binding, stapling, stitching, or any other binding mechanism.

Additional Embodiments

Figure 10A:
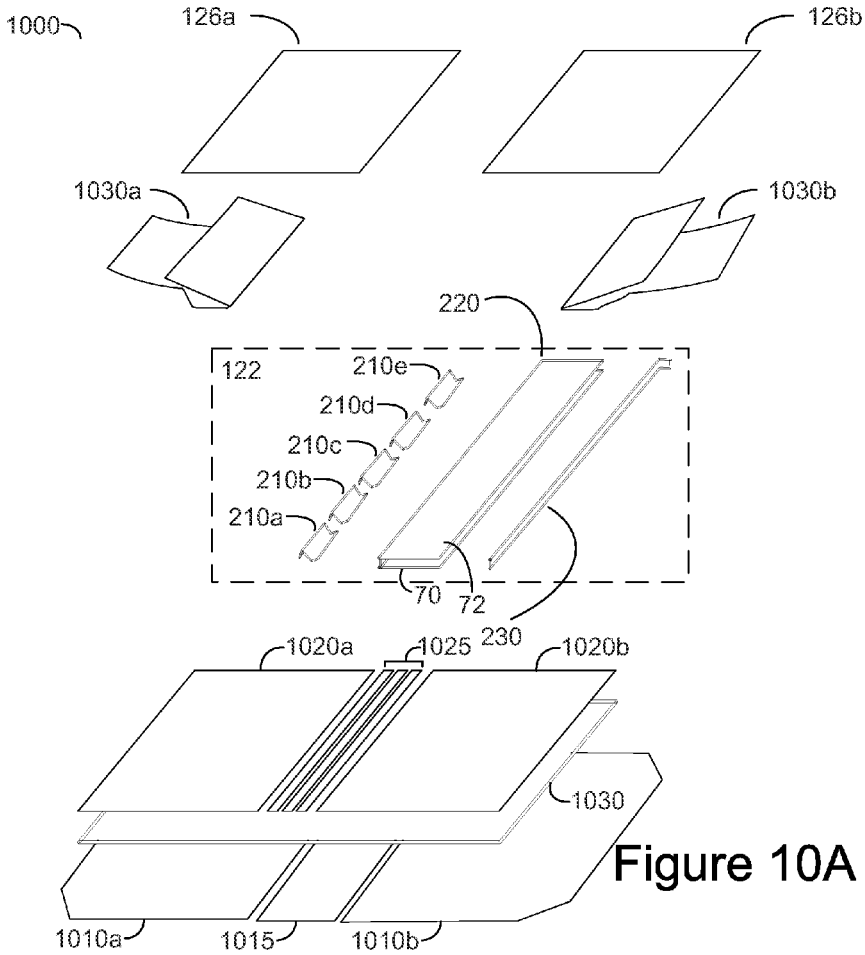
FIG. 10A is an exploded view of an embodiment of a media binder.
Figure 10B:
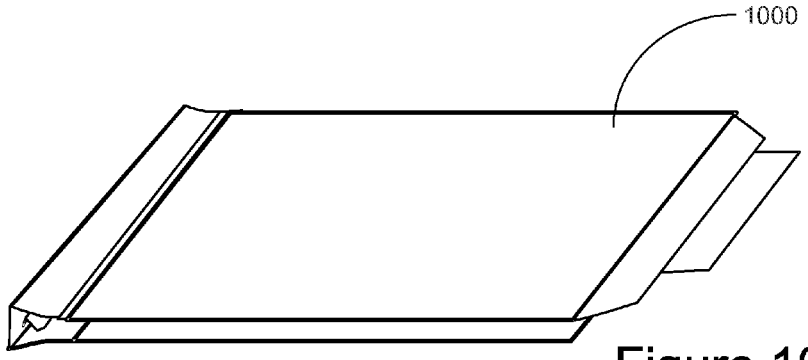
FIG. 10B is a perspective view of the media binder shown in FIG. 10A.

FIG. 10A shows an exploded view of an additional embodiment of a media binder 1000. In this embodiment, the cover and the binding mechanism are pre-assembled into a single-piece media binder 1000 at a manufacturing site. The single-piece media binder 1000 has one or more pockets that enable the creation of a full cover customization at a client site (e.g., retailer site). Because components are aligned and pre-assembled at the manufacturing site, the process to customize the cover and finalize the media binder 1000 at the client site is simple. FIG. 10B is a perspective view of the media binder 1000 assembled using the components shown in FIG. 10A.

As shown in FIG. 10A, the media binder 1000 includes a cover layer, a binding sheet layer, a surface board layer, a binding mechanism 122, a release liner layer, and a paste down layer. The surface board layer includes a front surface board 1020*a*, a back surface board 1020*b*, and one or more spine surface boards 1025. The surface boards 1020, 1025 may be formed of a durable material (e.g., a textile), a rigid planar material (e.g., paperboard, metal, plastic, fiber, or a stiff polymeric material), or one or more layers of such materials, and may have a thickness between 0.01 inch and 0.20 inch. The binding sheet layer includes a binding sheet 1030 that functions to bind the surface boards 1020, 1025 together and may be composed of material such as a substantially inelastic textile fabric.

The cover layer includes a front cover sheet 1010*a*, a back cover sheet 1010*b*, and a spine wrap 1015. The spine wrap 1115 attaches to the outwardly facing surface of the spine surface boards 1025 and adjacent portions of the surface boards 1020 (e.g., using an adhesive) and wraps around the side edges of the surface boards 1020, 1025 (e.g., by 0.08 inch or more) to ensure strong adhesion. The spine wrap 1015 may be formed of a durable material (e.g., a textile, plastic, organic such as leather).

The cover sheets 1010*a*, 1010*b* wraps around the side edges of the surface boards 1020*a*, 1020*b*, respectively. The cover sheets 1010 may be formed of a transparent material such as an acetate material and a single or composite polymeric film, and may have a thickness between 0.001 inch and 0.010 inch (e.g., 0.003 inch). One or two of the marginal edges of the cover sheets 1010 are wrapped around the side edges of the surface boards 1020 and pre-attached to the inwardly facing surface of the surface boards 1020 (e.g., using an adhesive), leaving the remaining edges loose for inserting a custom cover through the opening. The remaining marginal edges of the cover sheets 1010 (the "loose edges") may be loosely attached to the surface boards 1020 using an adhesive strip capable of repeated open and closure placed on the surface boards 1020, and can be readily re-opened and/or re-attached. As illustrated, the loose edge is the unbound edge the side edge opposite to the spine). Alternatively or additionally, the loose edges may also include the top edge and/or the bottom edge. The spine wrap 1015 may overlap the cover sheets 1010 by attaching to a portion of the outwardly facing surface of the cover sheets 1010 (e.g., by 0.008 inch or more) to both hold the cover sheets 1010 in place and to provide a margin of error where a custom cover may be slide under.

The binding mechanism 122 includes one or more spine clamps such as spine clamps 210*a*, 210*b*, 210*c*, 210*d*, 210*e*, a tension sheet 220, and a datum alignment member 230. The datum alignment member 230 is secured together with the spine clamps 210 and the tension sheet 220 during assembly of the binding mechanism 122. The side portions 70, 72 of the tension sheet 220 are attached to the inwardly facing surface of the surface boards 1020*a*, 1020*b*), respectively.

The paste down layer includes a front paste down 126*a* and a back paste down 126*b*, and functions to cover up the portions of the tension sheet 220 attached to the surface boards 1020 and to securely bind the loose edges of the cover sheets 1010 to the surface boards 1020 once the binder cover is customized. During assembly, portions of the paste downs 126 close to the binding edge (e,g., adjacent to the spine are attached to the surface boards 1020 to cover up the portions of the tension sheet 220 attached to the surface boards 1020. The remaining portions of the paste downs 126 (e.g., away from the spine) remain unattached from the surface boards 1020. A layer of adhesive is placed on the portions of the paste downs 126 unattached to the surface boards 1020*a*, 1020*b* with sheets of release liner (also called a "backing for paste down adhesive") 1030*a*, 1030*b* placed on top to cover the adhesive for ease of storage, operation, and transportation. The release liner 1030*a*, 1030*b* also have handles for ease of removal, as illustrated in FIG. 10B. The handles of the release liner 1030 may be folded around the paste downs 126*a*, 126*b*, respectively, for ease of transportation d handling. The paste downs 126 are formed of any number of mediums such as papers and films.

Figure 11:
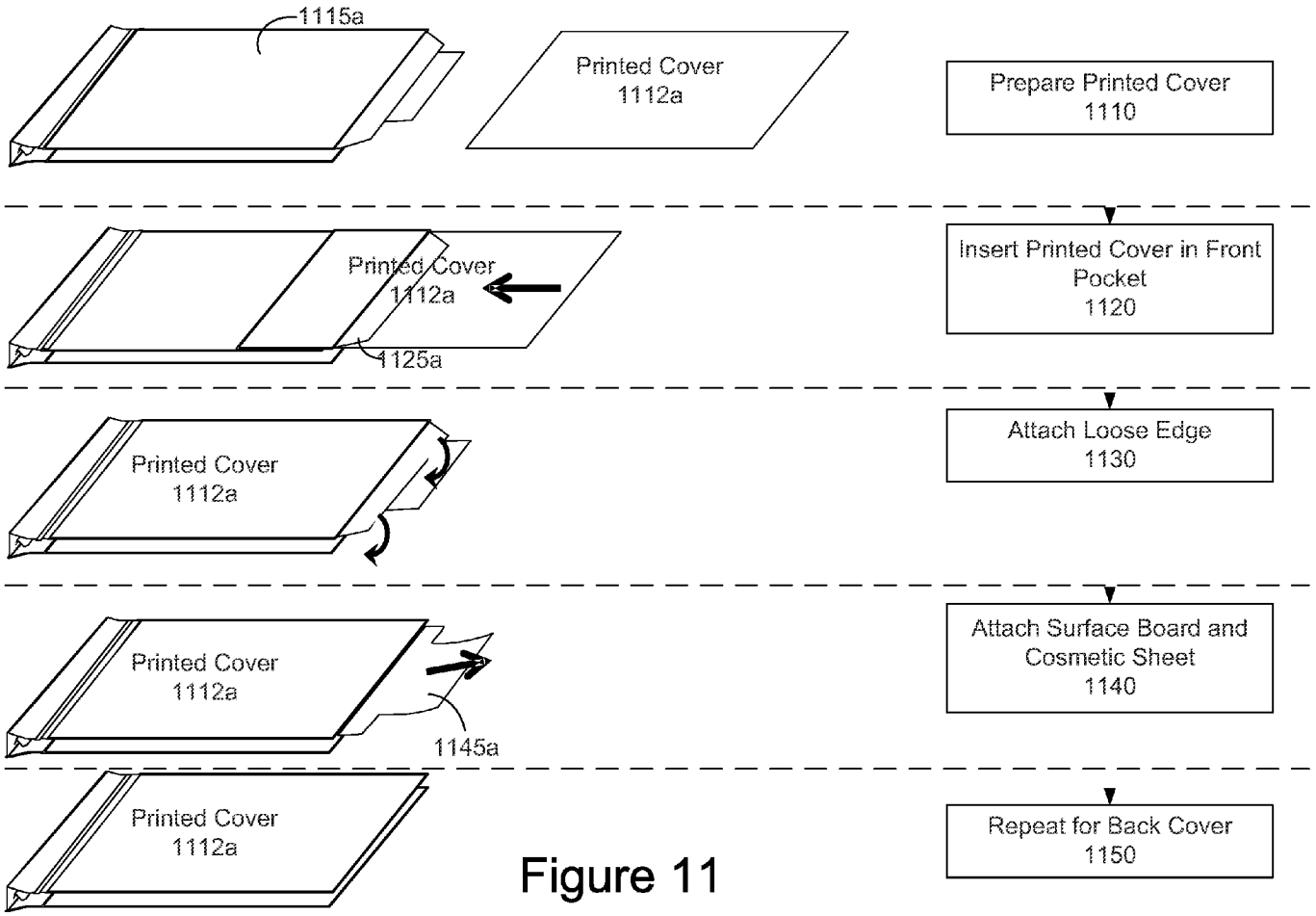
FIG. 11 is a flow diagram of an embodiment of a method of customizing case covers and finalizing the media binder shown in FIG. 10B.

FIG. 11 shows an embodiment of a method 1100 of customizing case covers and finalizing the media binder 1000, which is shown in FIG. 10B. Other embodiments perform the steps in different orders and/or perform different or additional steps than the ones shown in FIG. 11.

In step 1110, a front cover 1112*a* is printed and, if needed, cut to a desired size and shape that can fit into a front pocket 1115*a* of the media binder 1000, which is preassembled at the manufacturing site.

In step 1120, the loose edge 1125*a* of the front cover sheet 1010*a* is opened and the printed front cover 1112*a* is inserted into the front pocket 1115*a* from the resulting opening.

In step 1130, the loose edge 1125*a* is wrapped around the front surface board 1020*a* and attached to the surface board 1020*a* using the adhesive strip on the surface board 1020*a*.

In step 1140, the release liner 1030*a* is removed from the front paste down 126*a* (e.g., by pulling the handle 1145*a*) and the unattached portion of the front paste down 126*a* is attached to the front surface board 1020*a* using the adhesive on the front paste down 126*a*.

In one embodiment, the paste down 126*a* is formed of a rigid planar material (e. g., paperboard or a stiff polymeric material). In this embodiment, the layer of adhesive and the release liner 1030*a* covering the adhesive are optional, a d, if they are not present, the loose edge 1125*a* may be simply inserted in between the front surface board 1020*a* and the paste down 126*a*. As a result, in this embodiment, the user may replace the front cover 1112*a* in the front pocket 1115*a* whenever desired.

In step 1150, the steps 1110 through 1140 are repeated for the back cover to fully customize the case cover and finalize the media binder 1000. Because the cover sheets 1010 are wrapped around the surface boards on the top, bottom, and unbound edges, the finished media binder 1000 forms a finished binder cover appearance.

A layer of hot melt adhesive may be placed on the inwardly facing surfaces of the cover sheets 1010 and/or the outwardly facing surfaces of the binding sheet 1030, and the media binder 1000 may be passed through a laminating device to bind the printed covers to the cover sheets 1010 and/or the surface boards 1020. The media binder 1000 may be passed through in a closed position with an insertion (e.g., the alignment board 510) to ensure a constant thickness of the media binder 1000 relative to the spine. Alternatively, the media binder 1000 may be passed through the laminating device without the insertion, or be fed into the laminating device from the unbound edge up to the spine wrap 1015 in an open position or a closed position.

The method 1100 is easy and does not require specialized tools for the customization, thus may be practiced by low proficiency workforce at sites equipped with no or few specialized tools (e.g., a retail site, home). In addition, the printed covers used to customize the media binder 1000 are typically smaller than the printed covers used to customize the media binder 100, and thus may be printed using smaller printers that are more common at retailer sites and home environment.

In embodiments described herein, colorful borderlines (e.g., black) may be placed on the cover sheet (e.g., the cover sheets 138, 1010) on areas wrapping around side edges of the surface boards. The borderlines can serve to hide the underlying material at the side edge, and if the borderlines extend to cover the outwardly facing surface of the surface boards, to cover skew in the printed cover placed behind the cover sheets. For example, a thin black border (e.g., extending 0.04 inch to 0.20 inch in thickness from the side edges) can be painted on the inside of the cover sheets 1010 to cover any misalignment of the printed covers inserted behind.

One embodiment of the described subject matter is an side assembly of a media binder, comprising: at least one spring clamp, wherein each spring clamp (1) comprises opposing clamp edges that are operable to move resiliently toward and away from on another between a closed state and an open state and (2) defines an interior cavity operable to receive physical media during the open state; at least one tension sheet, wherein each tension sheet (1) attaches to the interior cavity and extends over at least one of the clamp edges and (2) operable to transmit an opening force from at least one board of the inside assembly to the at least one spring clamp; and at least one board, wherein each board comprises an inwardly facing surface and an outwardly facing surface, the inwardly facing surface is attached to the at least one tension sheet over at least one of the clamp edges, the outwardly facing surface comprises a layer of adhesive for attaching the inside assembly to a case of the media binder. The inside assembly further comprises at least one paste down, wherein each paste down is attached to (1) an inwardly facing surface of at least one tension sheet of the inside assembly over at least one of the clamp edges and (2) the inwardly facing surface of at least one board. The inside assembly further comprises at least one sheet of release liner, wherein each sheet of release liner is attached to the layer of adhesive on the outwardly facing surface of at least one board. The inside assembly further comprises at least one alignment artifact on the outwardly facing surface of at least one board. The at least one board is aligned with the clamp edges of the at least one spring clamp. The inside assembly further comprises an alignment board placed adjacent to the at least one board.

Another embodiment of the described subject matter is a method for creating an inside assembly of a media binder, comprising: attaching a tension sheet to an interior cavity defined by a spring clamp, wherein the spring clamp comprises opposing clamp edges that are operable to move resiliently toward and away from on another between a closed state and an open state and the tension sheet is extended over at least one of the clamp edges; attaching an inwardly facing surface of a board to the tension sheet over the clamp edges; and applying a layer of adhesive to an outwardly facing surface of the board. The method further comprises attaching a paste down to (1) an inwardly facing surface of the tension sheet over at least one of the clamp edges and (2) the inwardly facing surface of the board. The method further comprises attaching a sheet of release liner to the layer of adhesive on the outwardly facing surface of the board. The method further comprises placing at least one alignment artifact on the outwardly facing surface of the board. Attaching the inwardly facing surface of the board to the tension sheet over the clamp edges comprises aligning the board with the clamp edges. The method further comprises placing an alignment board adjacent to the board in the inside assembly.

Yet another embodiment of the described subject matter is a case assembly of a media binder comprising: a front surface board, at least one spine surface board, and aback surface board, wherein each surface board comprises an inwardly facing surface and an outwardly facing surface; and at least one cover sheet, wherein each cover sheet is wrapped around the outwardly facing surface of at least one surface board and comprises (1) at least one marginal edge attached to the inwardly facing surface of the at least one surface board and (2) at least one marginal edge unattached to the inwardly facing surface of the at least one surface board. A surface of the at least one cover sheet facing the at least one surface board comprises a layer of hot melt adhesive, and the outwardly facing surface of the at least one surface board comprises a layer of hot melt adhesive. The at least one cover sheet comprises a borderline approximate to a marginal edge of the at least one cover sheet. The at least one marginal edge unattached to the inwardly facing surface of the at least one surface board comprises an adhesive strip. The case assembly further comprises a binding sheet comprising an inwardly facing surface and an outwardly facing surface, wherein the inwardly facing surface of the binding sheet attaches to the outwardly facing surface of the front surface board, the at least one spine surface board, and the back surface board, and the outwardly facing surface of the binding sheet comprises a layer of hot melt adhesive.

One embodiment of the described subject matter is a method for customizing a case assembly, comprising: inserting a printed cover into an opening of a case assembly, the case assembly comprising at least one cover sheet wrapped around at least one surface board, wherein the at least one cover sheet comprises (1) at least one marginal edge attached to the at least one surface board and (2) at least one marginal edge unattached to the at least one surface board, and the opening is defined at least in part by the at least one marginal edge unattached to the at least one surface board; attaching the at least one marginal edge unattached to the at least one surface board to the at least one surface board; and laminating at least a portion of the case assembly. Attaching the at least one marginal edge unattached to the at least one surface board to the at least one surface board comprises: removing a release liner attached to an adhesive strip on the at least one marginal edge unattached to the at least one surface board; and attaching the at least one marginal edge unattached to the at least one surface board to the at least one surface board using the adhesive strip.

Another embodiment of the described subject matter is a media binder, comprising: an inside assembly, comprising: at least one spring clamp, wherein each spring clamp (1) comprises opposing clamp edges that are operable to move resiliently toward and away from on another between a closed state and an open state and (2) defines an interior cavity operable to receive physical media during the open state, at least one tension sheet, wherein each tension sheet (1) attaches to the interior cavity and extends over at least one of the clamp edges and (2) operable to transmit an opening force from at least one inside board of the inside assembly to the at least one spring clamp, and at least one inside board, wherein each inside board comprises an inwardly facing surface and an outwardly facing surface, the inwardly facing surface is attached to the at least one tension sheet over at least one of the clamp edges, the outwardly facing surface comprises a layer of adhesive; and a case assembly, comprising: a front surface board, at least one spine surface board, and a back surface board, wherein each surface board comprises an inwardly facing surface and an outwardly facing surface, at least one cover sheet, wherein each cover sheet is wrapped around the outwardly facing surface of at least one surface board and comprises at least one marginal edge attached to the inwardly facing surface of the at least one surface board, and a printed cover in between the at least one cover sheet and the front surface board; wherein the outwardly facing surface of the at least one inside board is attached to the inwardly facing surface of at least one of the front surface board and the back surface board using the layer of adhesive on the outwardly facing surface of the at least one inside board. The media binder further comprises at least one paste down, wherein each paste down is attached to (1) an inwardly facing surface of at least one tension sheet of the inside assembly over at least one of the clamp edges and (2) the inwardly facing surface of at least one inside board. At least one inside board is aligned with the clamp edges of the at least one spring clamp. The printed cover is laminated together with the at least one cover sheet using a layer of hot melt adhesive on the at least one cover sheet. The case assembly further comprises: a binding sheet comprising an inwardly facing surface and an outwardly facing surface, wherein the inwardly facing surface of the binding sheet attaches to the outwardly facing surface of the front surface board, the at least one spine surface board, and the back surface board, and wherein the printed cover is laminated together with the binding sheet using a layer of hot melt adhesive on the binding sheet. The at least one cover sheet comprises a borderline covering at least a portion of a side edge of at least one surface board.

Yet another embodiment of the described subject matter is a method for creating a media binder, comprising: aligning at least one inside board of an inside assembly with at least one surface board of a case assembly; and combining the inside assembly with the case assembly by attaching the inside board to the surface board using adhesive on the inside board, wherein the inside assembly comprises a binding mechanism and at least one tension sheet, the at least one tension sheet is attached to the binding mechanism and operable to transmit an opening force from the inside board to the binding mechanism. Aligning the at least one inside board with the at least one surface board comprises: registering the at least one inside board and the at least one surface board at an alignment tool. Aligning the at least one inside board with the at least one surface board comprises: matching at least one alignment artifact on the at least one inside board with at least one alignment artifact on the at least one surface board. Aligning the at least one inside board with the at least one surface board comprises: aligning the at least one surface board with an alignment board of the inside assembly.

One embodiment of the described subject matter is a media binder, comprising: a front surface board, at least one spine surface board, and a back surface board, wherein each surface board comprises an inwardly facing surface and an outwardly facing surface; a spine wrap wrapped around the outwardly facing surface of the at least one spine surface board; at least one cover sheet, herein each cover sheet is wrapped around the outwardly facing surface of at least one surface board and comprises (1) at least one marginal edge attached to the inwardly facing surface of the at least one surface board and (2) at least one marginal edge unattached to the inwardly facing surface of the at least one surface board; and a binding mechanism attached to the inwardly facing surface of the front surface board and the inwardly facing surface of the back surface board. The media binder further comprises at least one paste down, wherein each of the at least one paste down comprises an outwardly facing surface that comprises a first portion and a second portion, the first portion is attached to the inwardly facing surface of at least one surface board and the second portion comprises a layer of adhesive and a sheet of release liner covering the layer of adhesive.

Another embodiment of the described subject matter is a method for creating a media binder with a customized cover, comprising: inserting a printed cover into an opening of the media binder, the media binder comprising at least one cover sheet wrapped around at least one surface board, wherein the at least one cover sheet comprises (1) at least one marginal edge attached to the at least one surface board and (2) at least one marginal edge unattached to the at least one surface board, and the opening is defined at least in part by the at least one marginal edge unattached to the at least one surface board; attaching the at least one marginal edge unattached to the at least one surface board to the at least one surface board; and combining the at least one surface board with at least one paste down using adhesive on a first portion of the at least one paste down unattached to the at least one surface board, wherein a second portion of the at least one paste down is pre-attached to the at least one surface board.

One skilled in the art will recognize that the configurations and methods described above and illustrated in the figures are merely examples, and that the described subject matter may be practiced and implemented using many other configurations and methods. It should also be noted that the language used in the specification has been principally selected for readability and instructional purposes, and may not have been selected to delineate or circumscribe the inventive subject matter. Accordingly, the disclosure of the described subject matter is intended to be illustrative, but not limiting, of the scope of the subject matter, which is set forth in the following claims.

What is claimed is:

1. An inside assembly of a media binder, comprising:

at least one spring clamp, wherein each spring clamp (1) comprises opposing clamp edges that are to move resiliently toward and away from one another between a closed state and an open state and (2) defines an interior cavity to receive physical media during the open state;

at least one tension sheet, wherein each tension sheet (1) attaches to the interior cavity and extends over at least one of the clamp edges and (2) is to transmit an opening force from at least one board of the inside assembly to the at least one spring clamp;

at least one board, wherein each board comprises an inwardly facing surface and an outwardly facing surface, the inwardly facing surface is attached to the at least one tension sheet over at least one of the clamp edges, the outwardly facing surface comprises a layer of adhesive for attaching the inside assembly to a case of the media binder; and an alignment assembly including at least one of a hole and a pin placed on the outwardly facing surface of the at least one board to enable the inside assembly to align with the case of the media binder.

2. The inside assembly of claim 1, further comprising at least one paste down, wherein each paste down is attached to (1) an inwardly facing surface of at least one tension sheet of the inside assembly over at least one of the clamp edges and (2) the inwardly facing surface of at least one board.

3. The inside assembly of claim 1, further comprising at least one sheet of release liner, wherein each sheet of release liner is attached to the layer of adhesive on the outwardly facing surface of at least one board.

4. The inside assembly of claim 1, wherein the alignment assembly includes one hole and two pins on the outwardly facing surface of the at least one board.

5. The inside assembly of claim 1, wherein the at least one board is aligned with the clamp edges of the at least one spring clamp.

6. The inside assembly of claim 1, further comprising an alignment board placed adjacent to the at least one board.

7. A method for creating an inside assembly of a media binder, comprising:

attaching a tension sheet to an interior cavity defined by a spring clamp, wherein the spring clamp comprises opposing clamp edges that are to move resiliently toward and away from one another between a closed state and an open state and the tension sheet is extended over at least one of the clamp edges;

attaching an inwardly facing surface of a board to the tension sheet over the clamp edges;

applying a layer of adhesive to an outwardly facing surface of the board; and placing an alignment assembly including at least one of a hole and a pin on the outwardly facing surface of the board to enable the inside assembly to align with a case of the media binder.

8. The method of claim 7, further comprising:

attaching a paste down to (1) an inwardly facing surface of the tension sheet over at least one of the clamp edges and (2) the inwardly facing surface of the board.

9. The method of claim 7, further comprising:

attaching a sheet of release liner to the layer of adhesive on the outwardly facing surface of the board.

10. The method of claim 7, wherein placing the alignment assembly on the outwardly facing surface of the board includes placing one hole and two pins on the outwardly facing surface of the board.

11. The method of claim 7, wherein attaching the inwardly facing surface of the board to the tension sheet over the clamp edges comprises aligning the board with the clamp edges.

12. The method of claim 7, further comprising:

placing an alignment board adjacent to the board in the inside assembly.

13. A media binder, comprising:

an inside assembly, comprising:

at least one spring clamp, wherein each spring clamp (1) comprises opposing clamp edges that are to move resiliently toward and away from one another between a closed state and an open state and (2) defines an interior cavity to receive physical media during the open state, at least one tension sheet, wherein each tension sheet (1) attaches to the interior cavity and extends over at least one of the clamp edges and (2) is to transmit an opening force from at least one inside board of the inside assembly to the at least one spring clamp, at least one inside board, wherein each inside board comprises an inwardly facing surface and an outwardly facing surface, the inwardly facing surface is attached to the at least one tension sheet over at least one of the clamp edges, the outwardly facing surface comprises a layer of adhesive, and an alignment assembly including at least one of a hole and a pin placed on the outwardly facing surface of the at least one board; and a case assembly, comprising:

a front surface board, a spine surface board, and a back surface board, wherein each surface board comprises an inwardly facing surface and an outwardly facing surface, a cover sheet, wherein the cover sheet is wrapped around the outwardly facing surface of the front surface board and comprises at least one marginal edge attached to the inwardly facing surface of the front surface board, and a printed cover in between the cover sheet and the front surface board;

wherein the outwardly facing surface of the at least one inside board is attached to the inwardly facing surface of at least one of the front surface board and the back surface board using the layer of adhesive on the outwardly facing surface of the at least one inside board.

14. The media binder of claim 13, further comprising at least one paste down, wherein each paste down is attached to (1) an inwardly facing surface of at least one tension sheet of the inside assembly over at least one of the clamp edges and (2) the inwardly facing surface of at least one inside board.

15. The media binder of claim 13, wherein at least one inside board is aligned with the clamp edges of the at least one spring clamp.

16. The media binder of claim 13, wherein the printed cover is laminated together with the cover sheet using a layer of hot melt adhesive on the at least one cover sheet.

17. The media binder of claim 13, wherein the case assembly further comprises:

a binding sheet comprising an inwardly facing surface and an outwardly facing surface, wherein the inwardly facing surface of the binding sheet attaches to the outwardly facing surface of the front surface board, the spine surface board, and the back surface board, and wherein the printed cover is laminated together with the binding sheet using a layer of hot melt adhesive on the binding sheet.

18. The media binder of claim 13, wherein the cover sheet comprises a borderline covering at least a portion of a side edge of at least one surface board.

19. A method for creating a media binder, comprising:

aligning an inside board of an inside assembly with a surface board of a case assembly using an alignment assembly placed on the inside board of the inside assembly, wherein the alignment assembly includes at least one of a hole and a pin; and combining the inside assembly with the case assembly by attaching the inside board to the surface board using adhesive on the inside board, wherein the inside assembly comprises a binding mechanism and at least one tension sheet, the at least one tension sheet is attached to the binding mechanism and is to transmit an opening force from the inside board to the binding mechanism.

20. The method of claim 19, wherein aligning the inside board with the surface board comprises:

registering the inside board and the at least one surface board at an alignment tool.

21. The method of claim 19, wherein aligning the inside board with the surface board comprises:

matching the hole or pin of the alignment assembly on the inside board of the inside assembly with an alignment pin or an alignment hole placed on the surface board of the case assembly.

22. The method of claim 19, further comprising:

aligning the surface board of the case assembly with an alignment board of the inside assembly.

* * * * *